US010981286B2

(12) United States Patent
Efthimiadis et al.

(10) Patent No.: US 10,981,286 B2
(45) Date of Patent: Apr. 20, 2021

(54) RAZOR SYSTEM

(71) Applicant: BIC-VIOLEX SA, Anixi (GR)

(72) Inventors: Dimitrios Efthimiadis, Athens (GR); Panagiotis Kopelas, Dafni-Athens (GR)

(73) Assignee: BIC-VIOLEX SA, Anixi (GR)

( * ) Notice: Subject to any disclaimer, the term of this patent is extended or adjusted under 35 U.S.C. 154(b) by 35 days.

(21) Appl. No.: 16/302,180

(22) PCT Filed: Jun. 16, 2017

(86) PCT No.: PCT/EP2017/064845
§ 371 (c)(1),
(2) Date: Nov. 16, 2018

(87) PCT Pub. No.: WO2018/007131
PCT Pub. Date: Jan. 11, 2018

(65) Prior Publication Data

US 2019/0168402 A1 Jun. 6, 2019

Related U.S. Application Data

(60) Provisional application No. 62/358,673, filed on Jul. 6, 2016.

(51) Int. Cl.
*B26B 21/56* (2006.01)
*B26B 21/40* (2006.01)
*B26B 21/44* (2006.01)

(52) U.S. Cl.
CPC ..... *B26B 21/565* (2013.01); *B26B 21/4068* (2013.01); *B26B 21/4018* (2013.01); *B26B 21/4025* (2013.01); *B26B 21/443* (2013.01)

(58) Field of Classification Search
CPC ..... B26B 21/02; B26B 21/04; B26B 21/06; B26B 21/14; B26B 21/16; B26B 21/165;
(Continued)

(56) References Cited

U.S. PATENT DOCUMENTS 1,135,008 A * 4/1915 Fuller ..... B26B 21/56 30/32
2,030,833 A * 2/1936 Thompson ..... B26B 21/56 30/51
(Continued)

FOREIGN PATENT DOCUMENTS

EP 2661339 B8 * 3/2016 ..... B26B 21/565
EP 3530424 A1 * 8/2019 ..... B26B 21/565
(Continued)

OTHER PUBLICATIONS

International Search Report for PCT/EP2017/064845 dated Sep. 18, 2017.

*Primary Examiner* — Jason Daniel Prone
(74) *Attorney, Agent, or Firm* — Polsinelli PC

(57) ABSTRACT

A cutting member (1) for a shaving cartridge includes a front side, a back side opposing the front side, and a flat cutting portion (2) with a cutting edge portion (4). Further the cutting member includes a first bent portion (8), an intermediate portion (11), a second bent portion (9) and a base portion (10) that are made out of one single piece of material. The first bent portion is integral with the flat cutting portion. The first bent portion is convex on the back side of the cutting member, and the second bent portion is concave on the back side of the cutting member. The proposed shape of the cutting member resembles an "S" shape or a question mark shape.

8 Claims, 6 Drawing Sheets

(58) Field of Classification Search
CPC ... B26B 21/227; B26B 21/4031; B26B 21/56; B26B 21/565
USPC ..... 30/47–51
See application file for complete search history.

(56) References Cited

U.S. PATENT DOCUMENTS 3,949,470 A * 4/1976 Hall ..... B26B 21/22 30/50
4,200,976 A * 5/1980 Gooding ..... B26B 21/222 30/47
4,335,508 A * 6/1982 Francis ..... B26B 21/227 30/47
4,335,509 A * 6/1982 Smith ..... B26B 21/4043 30/48
4,442,598 A * 4/1984 Jacobson ..... B26B 21/227 30/47
4,774,765 A * 10/1988 Ferraro ..... B26B 21/227 30/50
5,224,267 A * 7/1993 Simms ..... B26B 21/227 30/50
5,416,974 A * 5/1995 Wain ..... B26B 21/227 30/50
5,671,534 A * 9/1997 Mayerovitch ..... B26B 21/44 30/48
5,715,606 A * 2/1998 de Wolf ..... B26B 21/227 30/48
7,131,202 B2 * 11/2006 Pennell ..... B26B 21/565 30/50
7,681,314 B2 * 3/2010 Follo ..... B26B 21/222 30/50
8,011,104 B2 * 9/2011 Masek ..... B21D 53/645 30/50
8,104,179 B2 * 1/2012 Nakasuka ..... B26B 21/227 30/50
9,032,628 B2 * 5/2015 Hobson, Sr. ..... B26B 21/565 30/50
10,220,532 B2 * 3/2019 Davos ..... B26B 21/565
10,369,714 B2 * 8/2019 Noh ..... B26B 21/56
2003/0159291 A1 * 8/2003 Clark ..... B26B 21/227 30/50
2005/0172489 A1 * 8/2005 Aviza ..... B26B 21/565 30/32
2008/0066315 A1 * 3/2008 Xu ..... B26B 21/565 30/50
2010/0011588 A1 * 1/2010 Wang ..... B26B 21/4031 30/50
2011/0289779 A1 12/2011 Vodolin et al.
2014/0123497 A1 * 5/2014 Zhuk ..... B26B 21/565 30/49
2014/0230252 A1 8/2014 Davos et al.
2014/0283387 A1 * 9/2014 Bozikis ..... B26B 21/4031 30/51
2016/0167104 A1 6/2016 Bykowski et al.

FOREIGN PATENT DOCUMENTS

WO 2009/137389 A1 11/2009
WO 2013/050608 A1 4/2013
WO WO-2018007130 A1 * 1/2018 ..... B26B 21/227
WO WO-2018007131 A1 * 1/2018 ..... B26B 21/565

* cited by examiner

RAZOR SYSTEM

CROSS REFERENCE TO RELATED APPLICATION

This application is a National Stage application of International Application No. PCT/EP2017/064845, filed on Jun. 16, 2017, now published as WO 2018/007131 and which claims priority to U.S. 62/358,673, filed Jul. 6, 2016, the entire contents of each is incorporated herein by reference.

FIELD

The present disclosure is related to cutting members for shaving cartridges, to blade supports, and to methods for manufacturing such cutting members.

BACKGROUND

Currently, shaving razors include one or more blades positioned within a blade portion of the housing. The cartridge is attached to a handle. The housing and the blades together form a razor cartridge.

Recently, it has been common for the blade to be supported/carried on a blade support, together forming a cutting member. Further, the cutting members are being used in razor cartridges, thus allowing the cutting member to move within some degree inside the housing during the shaving process. An increase in the number of blades used in the shaving cartridge leads to an improvement in the shaving efficiency, and a pressure to the skin of a user is well distributed. However, at the same time, an increasing number of blades decreases the space in the blade portion of the housing. That is, the space available for the flow of water and shaving remainders through the cartridge is decreased for a given shaving cartridge footprint. To enhance rinsability, there is a need to provide thinner blades which otherwise is difficult in sense of the minimum possible distance between the blades as well as the manufacture of the blades.

Due to the current design of the support of almost all movable blades, the loading of the blades is focused on the center of the blade thereby resulting in a need for supporting features in the housing. Rinsing of the cartridge containing the blades is much easier with movable blades but, by using thinner supports or integral bent blades in order to improve rinsing, additional supporting features of the housing are required, thus leading to blocked and/or restricted areas for rinsing. These supporting features of the housing create extra "obstacles" within the shaving head and therefore the rinsability of the head is greatly decreased, leading to debris accumulation and early blade dulling. Also, the deformation of the blade during shaving (for a shaving cartridge with specific dimensions) limits how thin the blade support and blade can be.

SUMMARY

Aspects of the disclosure include a cutting member for a shaving cartridge of a specific design that increases the overall shaving performance.

The cutting member for the shaving cartridge includes a front side; a back side;

a flat cutting portion having a cutting-edge portion; and a first bent portion, an intermediate portion, a second bent portion and a base portion made out of single piece of material.

The first bent portion is between said flat cutting portion and said intermediate portion. The cutting-edge portion is opposite to the first bent portion and the first bent portion is integral with said flat cutting portion. The second bent portion is between the intermediate portion and the base portion. The first bent portion is convex on the back side of the cutting-edge; and said second bent portion is concave on the back side of the cutting member.

The Blade Support Includes a front side;

a back side opposing said front side;

a platform portion;

a first bent portion;

an intermediate portion;

a second bent portion; and a base portion.

The platform portion extends towards the first bent portion. The intermediate portion extends between the first bent portion and the second bent portion; and the base portion extends downward from the second bent portion. The first bent portion is convex on the back side, and the second bent portion is concave on the back side.

The proposed shape of the new support resembles a question mark or "S" shape.

A method for manufacturing the cutting member for shaving cartridge includes the following steps:

providing a flat piece of material;

forming a flat cutting portion having a cutting edge;

forming a first bent portion, an intermediate portion, a second bent portion, and a base portion.

The first bent portion is formed between the flat cutting portion and the intermediate portion and is integral with the flat cutting portion. The second bent portion is between the intermediate portion and the base portion. The first bent portion is convex on the back side of the cutting member, and the second bent portion is concave on the back side of the cutting member.

EFFECT OF THE DISCLOSURE

The present disclosure involves a cutting member, that by having a specifically designed shape, is capable of providing a less aggressive profile of a blade. Thus, the blade is less abrasive to the skin of a user and cuts and injury are avoided. Furthermore, as compared to conventional shaving cartridges, the skin contours are followed more closely leading to an improved shaving efficiency. In addition, thinner blades and thinner supports are able to be incorporated into the shaving cartridge. Therefore, the manufacturing process is fast, efficient, reliable and the cost of the production could be possibly reduced.

BRIEF DESCRIPTION OF THE DRAWINGS

Other features and advantages of aspects of the present disclosure will appear from the following detailed description, given by way of non-limiting examples, and with reference to the accompanying drawings.

DETAILED DESCRIPTION

In the figures, the same references denote identical or similar elements.

Figure 1:
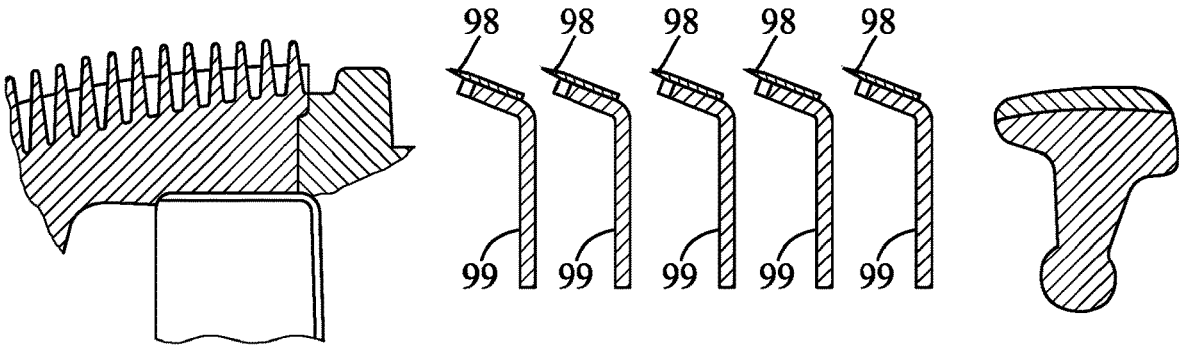
FIG. 1 is an exploded cross-sectional view of the conventional shaving cartridge.
Figure 2:
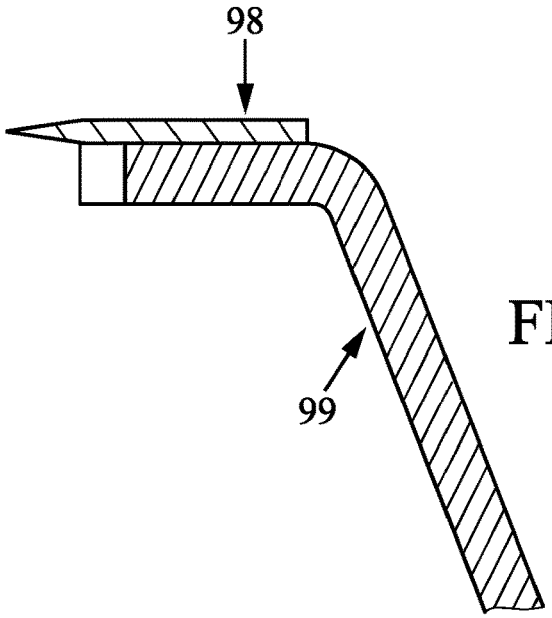
FIG. 2 is a vertical cross-sectional view of the conventional blade and support assembly used in the shaving cartridge of FIG. 1.

FIGS. 1 and 2 detail a conventional shaving cartridge including a plurality of blades 98 (also called "cutting portion") arranged within the housing. The plurality of blades 98 are each mounted on an elongated support 99, respectively. The blade 98 and blade support 99 form an assembly.

Figure 3:
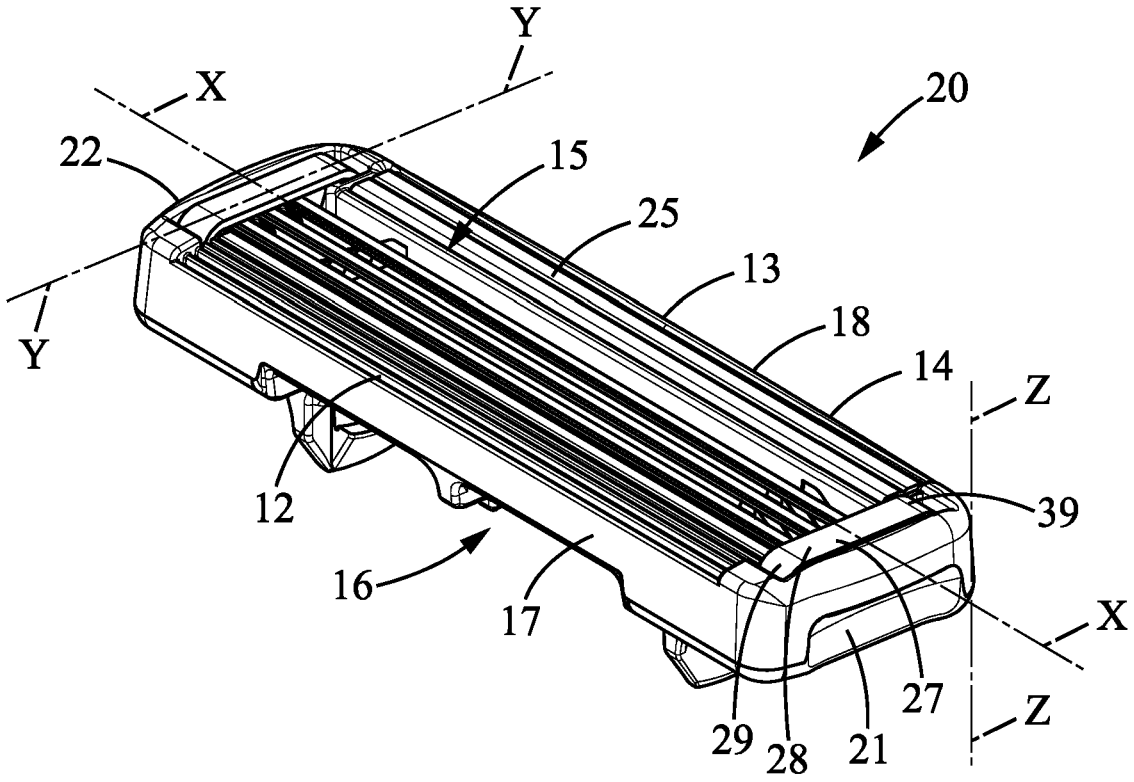
FIG. 3 is a perspective view of the shaving cartridge according to an aspect of the present disclosure.

Aspects of the present disclosure, as shown in FIG. 3, may include a shaving cartridge 20 including a housing 14 extending in a longitudinal direction, along an X-X axis. The housing 14 may be formed in a conventional rectangular shape. In some aspects, the housing 14 may also be different shapes, for example an oval shape.

The housing 14 may include a top portion 15, a bottom portion 16 opposing the top portion 15, a front portion 17, and a rear portion 18 opposing the front portion 17. The top portion 15 and the bottom portion 16 of the housing may be parallel to each other. The front portion 17 and the rear portion 18 may face each other and may include a plurality of side portions. The plurality of side portions may be a first side portion 21 and a second side portion 22. The front portion 17 and the rear portion 18 may extend in a lateral direction along a lateral axis Z-Z, between the top portion 15 and a bottom portion 16 of the housing 14. The lateral axis Z-Z may intersect the longitudinal axis X-X and may be perpendicular or form a different angle to the longitudinal axis X-X. The first side portion 21 and the second side portion 22 may extend between the front portion 17 and the rear portion 18 of the housing in a transverse direction, along a transverse axis Y-Y. The transverse axis Y-Y may be orthogonal or form a different angle to the longitudinal axis X-X and to the lateral axis Z-Z.

The housing 14 may be made out of plastic material. Also, other materials may be used to form the housing 14 as well. The housing 14 may also be made out of a combination of two or more different materials. The housing 14 may also include a connecting mechanism which may allow, directly or via an intermediate adaptor, for connection of the shaving cartridge 20 to a handle.

The housing 14 may include a guard bar 12 adjacent to the front portion 17 of the housing 14 and a cap 13 adjacent to the rear portion 18 of the housing 14. The cap 13 or the guard bar 12 may include a lubricating element 25 which may be oriented adjacent to the top portion 15 of the housing 14 and configured to come into contact with the skin of a user during the shaving procedure.

Figure 4:
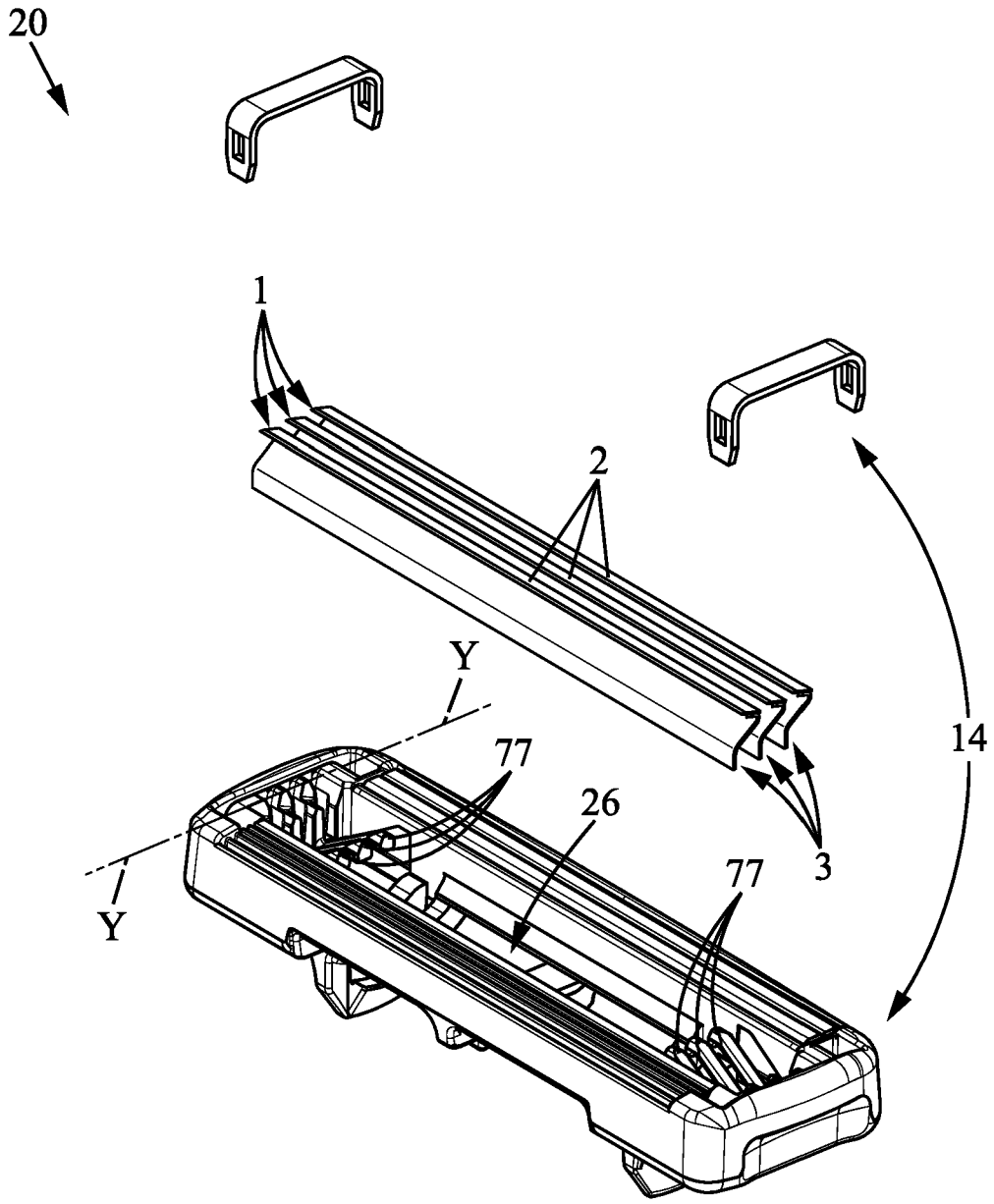
FIG. 4 is an exploded perspective view of the shaving cartridge of FIG. 3.

The housing 14 may include a blade receiving portion 26. The blade receiving portion 26, as shown in FIG. 4, may be disposed on the top portion 15 of the housing 14, between the front portion 17 and the rear portion 18 of the housing 14. The blade receiving portion 26 may define a recess and may be configured to receive at least one cutting member 1. The at least one cutting member 1 may be mounted in the blade receiving portion 26 between the front portion 17 of the housing 14 and the rear portion 18 of the housing 14 and between the first side portion 21 and the second side portion 22 of the housing 14. Each cutting member 1 may extend in the longitudinal direction along the longitudinal axis X-X. The blade receiving portion 26 may have a conventional rectangular shape.

Figure 9:
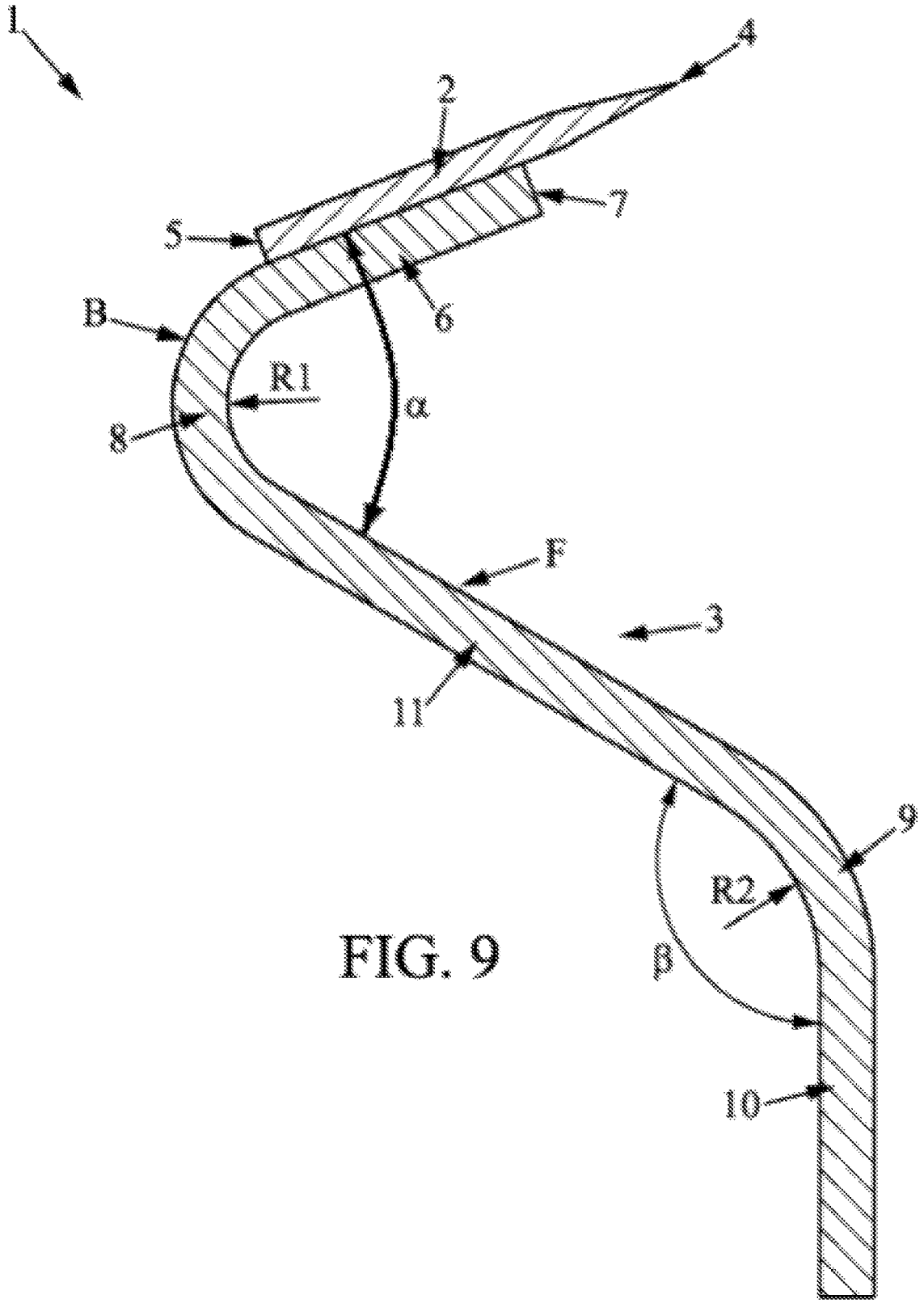
FIG. 9 is an enlarged side cross-sectional view of the cutting member of FIG. 6.
Figure 11:
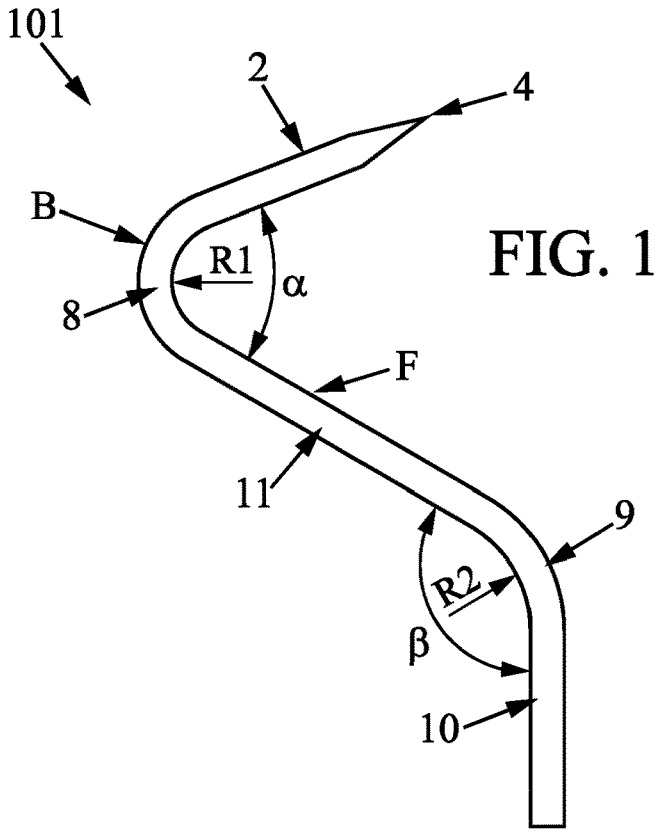
FIG. 11 is a cross sectional view of a cutting member of another aspect of the present disclosure.

The at least one cutting member 1 may include a back-side B and a front side F. As depicted in FIG. 9 or 11, for example, the back-side B of the cutting member may be a surface of the cutting member 1, 101, along the lateral axis Z-Z, oriented towards the cap 13, (i.e. a surface of the cutting member 1, 101 oriented towards the rear portion 18 of the housing 14). The front side F of the cutting member may be opposed to the back-side B. More specifically, the front side F of the cutting member may be a surface of the cutting member 1, 101, along the lateral axis Z-Z, oriented towards the guard bar 12, (i.e. a surface of the cutting member 1, 101 oriented towards the front portion 17 of the housing 14).

According to an aspect, the at least one cutting member 1 may include a flat cutting portion 2 having a cutting-edge portion 4 and an end portion 5 opposing the cutting-edge portion 4.

The cutting member 1 may also include a platform portion 6, a first bent portion 8, an intermediate portion 11, a second bent portion 9, and a base portion 10. The cutting-edge portion 4 may be opposite to the first bent portion 8. The platform portion 6 may have a front end 7 adjacent to the cutting-edge portion 4. The platform portion 6 may be made out of one single piece of material with the first bent portion 8, the intermediate portion 11, the second bent portion 9 and the base portion 10. The flat cutting portion 2 may be mounted on the platform portion 6. In other words, the platform portion 6 may be configured to carry or to support the flat cutting portion 2. The platform portion 6, the first bent portion 8, the intermediate portion 11, the second bent portion 9 and the base portion 10 together form the support portion 3 seen in FIGS. 4-10.

The flat cutting portions 2 may be attached to the platform portion 6 by welding techniques or any other techniques such as gluing or adhesives may also be used. The first bent portion 8 may be integral with the flat cutting portion 2.

The support portion 3 may be made for example out of a plastic material, or any other suitable materials may also be used. In a case when support portion 3 is made out of plastic, the support portion 3 may be injection molded. Moreover, the support portion 3 may be formed by extrusion.

Figure 5:
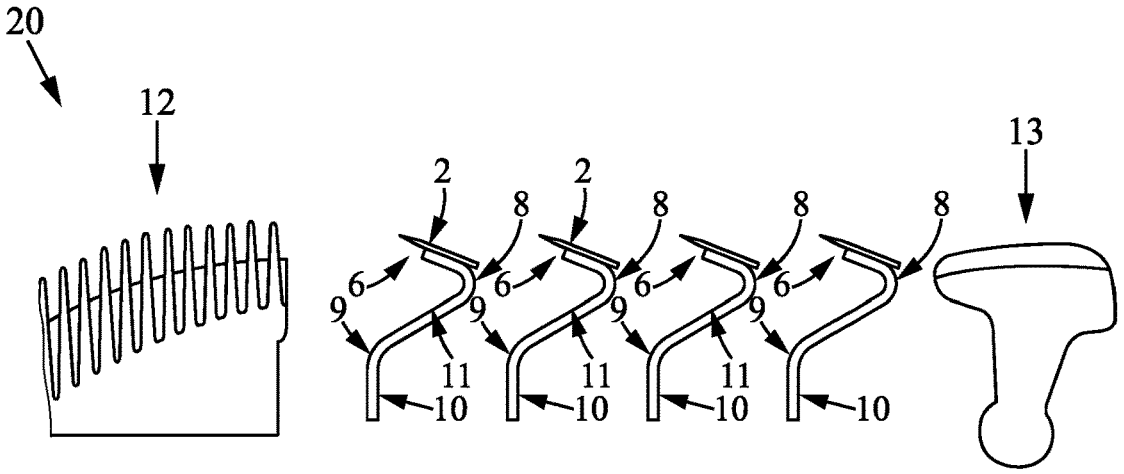
FIG. 5 is an exploded cross-sectional view of a shaving cartridge of according to another aspect of the present disclosure.
Figure 6:
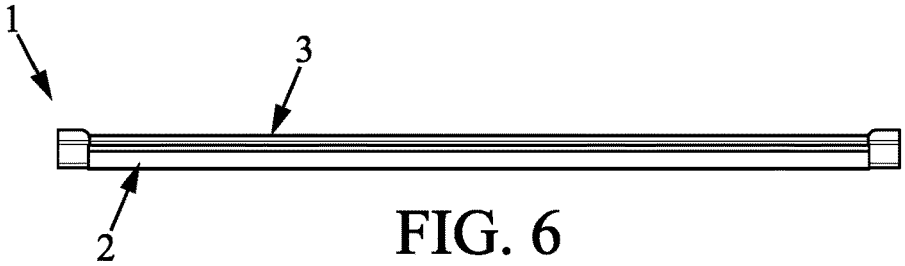
FIG. 6 is a top view of a cutting member of an aspect of the present disclosure.
Figure 7:
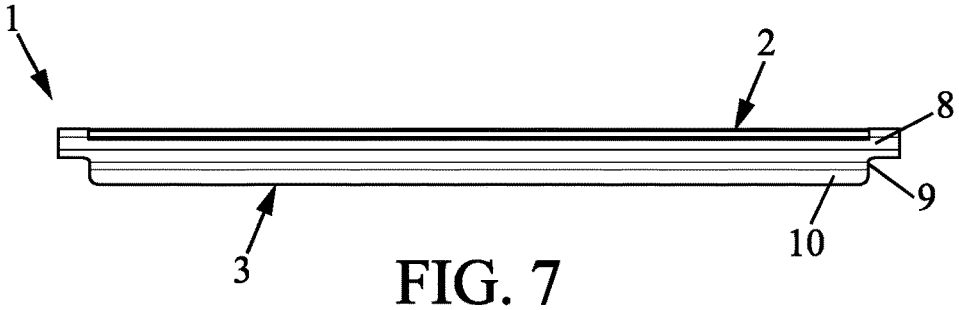
FIG. 7 is a front side view of the cutting member of FIG. 6.
Figure 8:
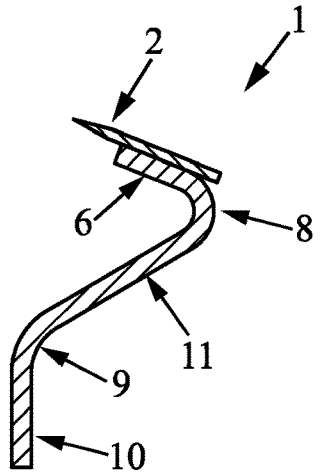
FIG. 8 is a side sectional view of the cutting member of FIG. 6.

As depicted in FIGS. 8 and 9, the flat cutting portion 2 may be carried by the platform portion 6. As shown in FIG. 5, each flat cutting portion 2 may be supported on the platform portion 6, respectively, together creating a plurality of cutting members 1.

The flat cutting portion 2 may be exposed via the top portion 15 of the housing 14. The flat cutting portion 2 of the cutting member 1 may be at least one blade. The blade may be made out of various materials, such as ceramics or metal.

According to some aspect, as shown in FIGS. 3 and 4, the shaving cartridge 20 may include three cutting members 1. According to other aspects, the shaving cartridge 20 may include more or less than three cutting members 1. As illustrated in FIG. 5 the shaving cartridge 20 may include four cutting members 1. That is, the number of the cutting members 1 may vary. As shown in FIG. 3, the flat cutting portion 2 may extend along the longitudinal axis X-X. The cutting-edge portion 4 may be accessible at the top portion 15 of the housing 14 to cut the hair during the shaving process. The flat cutting portion 2 may define a cutting portion plane.

The platform portion 6 may extend towards the first bent portion 8. The platform portion 6 may be connected to the flat cutting portion 2, and may be configured to support the flat cutting portion 2. The end portion 5 of the flat cutting portion 2 may be near/adjacent to the first bent portion 8 as shown in FIG. 9. The first bent portion 8 may be between the platform portion 6 and the intermediate portion 11, (i.e. the first bent portion 8 may extend between the platform portion 6 and the intermediate portion 11). The first bent portion 8 may be formed so as to be concave on the front side F of the cutting member 1, (i.e. the first bent portion 8 may have a concave shape on the front side F). By concave shape, it is meant that a shape is curved inward. Taken from the back-side B of the cutting member, the first bent portion 8 may be formed in a convex shape. By convex shape it is meant the opposite of the concave shape, (i.e. a convex shape is bulged outward). In other words, the first bent portion 8, when viewed from the rear portion 18 of the housing 14 may be formed into the convex shape; and as viewed from the front portion 17 of the housing 14, the first bent portion 8 may have the concave shape. The intermediate portion 11 may extend between the first bent portion 8 and the second bent portion 9.

Figure 10:
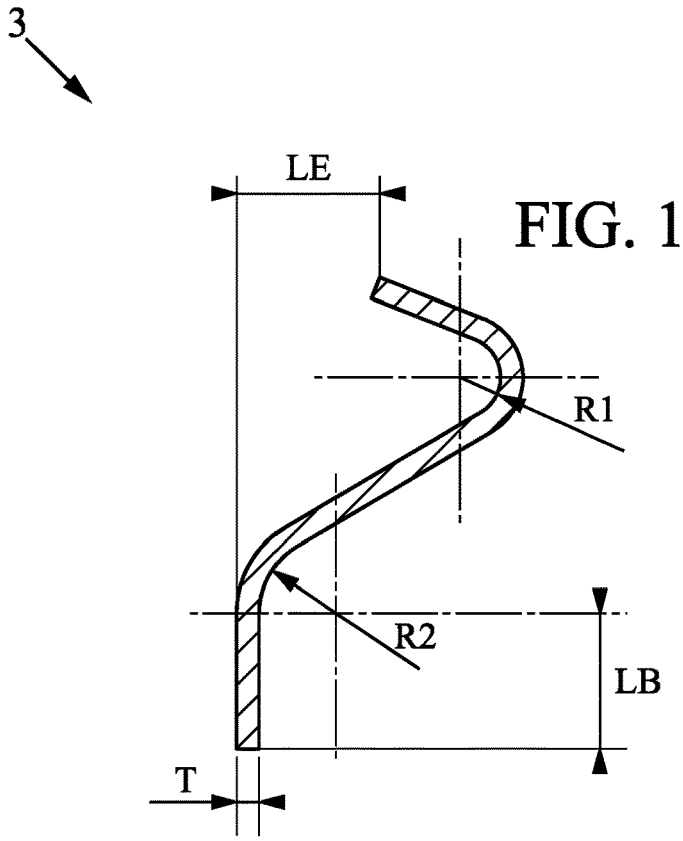
FIG. 10 is a cross sectional view of the support portion without the blade according to an aspect of the present disclosure.

Referring to FIG. 9, a first angle $\alpha$ formed between the flat cutting portion 2 and the intermediate portion 11 may be between 45° to 80°. According to some aspects, the first angle $\alpha$ may be between 50° and 70° and according to other aspect, may be about 52°. The second bent portion 9 may be formed between the intermediate portion 11 and the base portion 10. The second bent portion 9 may be intermediate to the base portion 10 and the intermediate portion 11. The second bent portion 9 may be formed in the convex shape on the front side F of the cutting member 1, (i.e. the second bent portion 9 when viewed from the front portion 17 of the housing 14, where the guard bar 12 may be present, may assume the convex shape. In other words, the second bent portion 9 may be formed to be concave on the back-side B of the cutting member 1. A second angle $\beta$, formed between the intermediate portion 11 and the base portion 10 may be between 100° and 160°. According to some aspects, the second angle $\beta$ may be between 120° and 140°, and according to some aspects may be about 130°. The base portion 10 may extend downward from the second bent portion 9. The base portion may have a length LB, as shown in FIG. 10. The length LB may be between 0.6 mm to 1.2 mm. According to some aspects, the length LB may be between 0.65 mm to 1.0 mm and according to other aspects, may be about 0.70 mm.

According to an aspect, as shown in FIG. 10, a thickness (dimension T) the single piece of material used to form the cutting member may be between 0.07 mm and 0.18 mm. According to further aspects, the thickness T may be between 0.10 mm and 0.15 mm, and according to other aspect, may be about 0.12 mm.

A dimension LE, seen on FIG. 10, may be a distance at which the base portion 10 may exceed the platform portion 6. More particularly, LE may be the distance measured from the front end 7 of the platform portion to the front side F of the base portion 10 along the transverse axis Y-Y. The LE may be between the 0.35 mm and 1.00 mm According to some aspects, for example, when the flat cutting portion 2 is not mounted to the platform 6, the dimension LE may be between 0.5 mm and 0.9 mm, and according to further aspects, about 0.75 mm. When the flat cutting portion 2 is mounted on the platform portion 6, the dimension LE, according to some aspects may be measured from the cutting-edge portion 4 of the flat cutting portion 2 to the front side F of the base portion 10. For example, the dimension LE may be between 0 mm and 0.6 mm. According to some aspects, the dimension LE may be between 0.3 mm and 0.5 mm and according to further aspects may be about 0.40 mm.

A conventional blade support 99 (e.g. as shown in FIG. 2) has a thickness of approximately 0.28 mm.

According to further aspect as shown in FIGS. 9 and 11, the first bent portion 8 may have a first inner radius of curvature R1, also called "first radius of curvature", that may be between 0.09 mm and 0.27 mm. For example, the radius of curvature R1 may be between 0.12 mm and 0.24 mm; however, according to some aspects, the radius of curvature R1 may be about 0.21 mm. The second bent portion 9 may have a second inner radius of curvature R2, also called "second radius of curvature", that may be between 0.1 mm and 0.7 mm. For example, the radius of curvature R2 may be between 0.3 mm and 0.5 mm; however, according to some aspects, the radius of curvature R2 may be about 0.4 mm.

According to some aspects, the cutting member 1 may resemble a question mark or "S"-shape. The "S"-shaped cutting member 1 or question mark cutting member 1 may lead to the blade having a less aggressive profile, thereby resulting in better fluidity and fewer nicks and cuts occurring on the skin during the shaving. The skin of the user may contour may be more easily and more closely followed thereby leading to an overall improved shaving performance. The question mark-shaped support may allow for the use of thinner blades and thinner supports. Consequently, the cost of production may be decreased.

According to further aspects, the at least one cutting member 1, 101 may be movably mounted along the lateral axis Y-Y in the blade receiving portion 26. For example, the cutting member 1, 101 may be carried by two elastic fingers 77. The elastic fingers 77 may extend in the blade receiving portion 26 towards each other and upwardly from each one of the plurality of side portions 21, 22 of the housing 14. For example, when the flat cutting portion 2 is supported on the platform portion 6, the support portion may be carried by the elastic fingers 77 as shown on FIG. 4.

The at least one cutting member 1, 101 may be retained on the housing 14 by retaining members 27. A retaining member 27 may be, for example, a clip. The clip 27 may have a regular U shape and may comprise a body 28 and at least two legs 29, 39, as seen on FIG. 3. The body 28 of the clip may extend between said at least to legs 29, 39 and along the transversal axis Y-Y. The clip 27 may be located to face the cutting-edge portion 4 and thus retain the cutting member 1, 101 within the housing 14. The at least one cutting member 1, 101 may be retained on the housing 14 also by retainers or by an ultrasonic welded cap.

According for further aspects, as shown in FIG. 11, the at least one cutting member 101 may be an integrally formed cutting member 101. In other words, the flat cutting portion 2 may be made out of one single piece of material with the first bent portion 8, the intermediate portion 11, the second bent portion 9 and the base portion 10. The flat cutting portion may extend towards the first bent portion 8 and may be integral with the first bent portion 8. The flat cutting portion 2 may include the cutting-edge portion 4. The cutting-edge portion 4 may be opposite to the first bent portion 8. The cutting-edge portion 4 may be accessible at said top portion 15 of the housing 14 to cut the hair during the shaving procedure. The flat cutting portion 2 may extend along the longitudinal axis X-X. The cutting member 101 may include a back-side B, a front side F, a first angle $\alpha$ and a second angle $\beta$, a first radius of curvature R1, a second radius of curvature R2, as explained above.

Further aspects may include a process for manufacturing a cutting member 1, 101 for a shaving cartridge.

The process for manufacturing the cutting member 1, 101 for a shaving cartridge 20 may include:

providing a flat piece of material;

forming a flat cutting portion 2 having a cutting-edge portion 4;

forming a first bent portion 8, an intermediate portion 11, a second bent portion 9, and a base portion 10. The first bent portion 8 may be formed between the flat cutting portion 2 and the intermediate portion 11 and may be integral with the flat cutting portion 2. The second bent portion 9 may be formed between the intermediate portion 11 and the base portion 10. The first bent portion 8 may be convex on the back-side B of the cutting member 1, 101; and the second bent portion 9 may be concave on a back-side B of the cutting member 1, 101.

According some aspect, the method may further include one or more of the following steps:

forming a platform portion 6 that may extend towards said first bent portion 8 and may be made out of one piece of material with the first bent portion 8, the intermediate portion 11, the second bent portion 9, and the base portion 10. The platform portion 6 may be configured to support the cutting member 1, 101. The first bent portion 8 may be formed as a convex on the back-side B of the cutting member 1, 101. The method may further include forming the second bent portion 9 concave on the back-side B of the cutting member 1, 101 and assembling the flat cutting portion 2 on the platform portion 6.

According to further aspects, the method may include the step of forming the flat cutting portion 2 into a single piece of material with the first bent portion 8, the intermediate portion 11, the second bent portion 9, and the base portion 10. The flat cutting portion 2 may be configured to extend towards the first bent portion 8.

Other embodiments of the disclosure are within the scope of the appended claims.

The invention claimed is:

1. A cutting member for a shaving cartridge comprising:

a flat cutting portion having a first end and a second end opposite the first end, the second end including a cutting-edge portion;

a first bent portion, an intermediate portion, a second bent portion, and a base portion made out of one single piece of material, wherein each of the first bent portion, the intermediate portion, the second bent portion, and the base portion have a front side and a back side opposite the front side together defining a front side and a back side of the cutting member;

the first bent portion being positioned between the flat cutting portion and the intermediate portion, the first bent portion being closer to the first end of the flat cutting portion than the second end and the cutting-edge portion, wherein the front side of the intermediate portion defines a first intermediate plane, wherein the flat cutting portion includes a side that defines a flat cutting plane, wherein the first bent portion forms an angle of between 45° and 80° between the flat cutting plane and the first intermediate plane;

the second bent portion being positioned between the intermediate portion and the base portion, the back side of the intermediate portion defining a second intermediate plane and the back side of the base portion defining a base plane, the second bent portion forming an angle of between 100° to 160° between the second intermediate plane and the base plane;

the back side of the first bent portion being convex, and the back side of the second bent portion being concave.

2. The cutting member according to claim 1, further comprising a platform portion having a front end that is made out of the one single piece of material; the platform portion extends towards the first bent portion, and wherein the side of the flat cutting portion is mounted on the platform portion.

3. The cutting member according to claim 2, wherein the platform portion is substantially linear, wherein the platform portion has a length of between 0.2 mm and 1.5 mm from the front end to the first bent portion.

4. The cutting member according to claim 1, wherein the flat cutting portion is integral with the first bent portion and is made of the one single piece of material; and wherein the flat cutting portion extends towards the first bent portion.

5. The cutting member according to claim 1, wherein the single piece of material has a thickness of between 0.07 mm and 0.18 mm.

6. The cutting member according to claim 1, wherein the intermediate portion is substantially linear, wherein the intermediate portion has a length of between 0.8 mm and 1.6 mm from the first bent portion to the second bent portion.

7. The cutting member according to claim 1, wherein the front side of the first bent portion includes a first radius of curvature of between 0.09 mm and 0.27 mm.

8. A shaving cartridge comprising at least one of the cutting member of claim 1.

* * * * *